US005298032A

United States Patent [19]

Schlenker et al.

[11] Patent Number: 5,298,032

[45] Date of Patent: Mar. 29, 1994

[54] PROCESS FOR DYEING CELLULOSIC TEXTILE MATERIAL WITH DISPERSE DYES

[75] Inventors: Wolfgang Schlenker, Basel; Peter Liechti, Arisdorf; Dieter Werthemann, Basel; Angelo D. Casa, Riehen, all of Switzerland

[73] Assignee: Ciba-Geigy Corporation, Ardsley, N.Y.

[21] Appl. No.: 941,581

[22] Filed: Sep. 8, 1992

[30] Foreign Application Priority Data

Sep. 11, 1991 [CH] Switzerland ..... 2668/91

[51] Int. Cl.[5] ..... D06P 1/02

[52] U.S. Cl. ..... 8/475; 8/662; 8/665; 8/916; 8/918; 8/930; 8/934

[58] Field of Search ..... 8/475

[56] References Cited

U.S. PATENT DOCUMENTS

| | | | |
|---|---|---|---|
| 3,706,525 | 12/1972 | Blackwell et al. | 8/532 |
| 4,049,377 | 9/1977 | Schwab et al. | 8/532 |
| 4,239,491 | 12/1980 | Baumgarte et al. | 8/532 |
| 4,294,581 | 10/1981 | Mensch et al. | 8/532 |
| 5,199,956 | 4/1993 | Schlenker | 8/473 |

FOREIGN PATENT DOCUMENTS

| | | |
|---|---|---|
| 474599 | 3/1992 | European Pat. Off. . |
| 474600 | 3/1992 | European Pat. Off. . |
| 514337 | 11/1992 | European Pat. Off. . |
| 3906724 | 9/1990 | Fed. Rep. of Germany . |

*Primary Examiner*—Paul Lieberman
*Assistant Examiner*—Necholus Ogden
*Attorney, Agent, or Firm*—Marla J. Mathias; George R. Dohmann

[57] ABSTRACT

Cellulosic textile materials can be dyed with disperse dyes from supercritical $CO_2$ by treating the textile materials with an auxiliary that promotes dye uptake, typically polyethylene glycol.

20 Claims, No Drawings

PROCESS FOR DYEING CELLULOSIC TEXTILE MATERIAL WITH DISPERSE DYES

The present invention relates to a process for dyeing cellulosic textile material with disperse dyes.

Cellulosic textile materials are ordinarily dyed from aqueous dye liquors, but without complete bath exhaustion, i.e. quantitative exhaustion of the dyes on to the substrate to be dyed, ever being attained. The consequence is that the residual dye liquor remaining after the dyeing process still contains more or less substantial amounts of dye, irrespective of the particular dyes and substrates. Dyeing therefore results in the formation of fairly large amounts of coloured effluents the necessary purification of which is troublesome and expensive.

It is taught in DE-A-3 906 724 that polyester fabrics can be dyed from supercritical $CO_2$ with disperse dyes by heating the textile material and the disperse dye under a $CO_2$ pressure of c. 190 bar for about 10 minutes to c. 130° C. and subsequently increasing the volume, whereby the $CO_2$ expands.

It is not, however, possible to dye cellulosic textile material by this process with the acid or reactive dyes normally used for such material. Even with disperse dyes only a completely unsatisfactory dyeing is obtained, and often indeed the textile material is merely stained.

It has now been found that it is also possible to dye cellulosic textile material with disperse dyes from supercritical $CO_2$ by pretreating the textile material with an auxiliary that promotes dye uptake.

Accordingly, the invention relates to a process for dyeing cellulosic textile material with disperse dyes, which comprises pretreating the textile material with an auxiliary that promotes dye uptake and subsequently dyeing the pretreated material with a disperse dye from supercritical $CO_2$.

Surprisingly, it is possible to dye cellulosic textile material by the process of this invention with disperse dyes, such that with many dyes even deep shades can be obtained.

The novel process has a number of advantages over dyeing methods carried out from an aqueous liquor. Because the $CO_2$ does not escape into the wastewater but is re-used after dyeing, no wastewater pollution occurs. In addition, the mass transfer reactions necessary for dyeing the textile substrate proceed in the novel process much faster than in aqueous systems. This in turn results in especially good and rapid penetration of the dye liquor into the textile substrate to be dyed. When dyeing wound packages by the inventive process, penetration of the dye liquor into the package causes none of the unlevelness defects which, in standard dyeing processes for beam dyeing flat goods, are regarded as the cause of listing. The novel process also does not give rise to the undesirable agglomeration of disperse dyes which sometimes occurs in standard processes for dyeing with disperse dyes, so that the known reduction in shade of disperse dyes which may occur in standard processes in aqueous systems, and hence the spotting associated therewith, can be avoided.

A further advantage of the novel process resides in the use of disperse dyes which consist exclusively of the dye itself and do not contain the customary dispersants and diluents.

The term "supercritical $CO_2$" means $CO_2$ the pressure and temperature of which are above the critical pressure and the critical temperature. In this state the $CO_2$ has approximately the viscosity of the corresponding gas and a density which is more or less comparable with the density of the corresponding liquified gas.

Suitable auxiliaries that promote dye uptake are those compounds which, under the dyeing conditions applied for dyeing from supercritical $CO_2$, result in the cellulosic material adsorbing or absorbing more dye than without the use of these compounds. They are preferably hydroxyl group containing organic compounds such as alkylene glycols or polyalkylene glycols as well as ethers or esters of these compounds, alkanolamines or aromatic compounds carrying several hydroxyl groups. Preferably the auxiliaries are polyethylene glycols, polypropylene glycols, di- or trialkanolamines containing 2 to 5 carbon atoms in the alkyl moieties, or phenol derivatives containing 1 to 3 OH groups. Particularly preferred auxiliaries are resorcinol, triethanolamine and polyethylene glycol, most preferably polyethylene glycol having a molecular weight of 300 to 600, more particularly of c. 400.

These auxiliaries are added in an amount of 5 to 60% by weight, preferably of about 10 to 30% by weight, based on the weight of the textile material.

The pretreatment with the auxiliaries can be carried out from an aqueous liquor, conveniently by padding the textile material with an aqueous solution of the auxiliary, pinching off the impregnated material and then drying it under such conditions that the auxiliary that promotes dye uptake remains on the textile material.

The pretreatment with the auxiliary can, however, also be carried out in supercritical $CO_2$, conveniently by heating the textile material and the auxiliary in an autoclave in supercritical $CO_2$ to elevated temperature, typically in the range from about 90° to 200° C., preferably under a pressure of about 73 to 400 bar, more particularly from about 150 to 250 bar. After releasing the pressure and opening the autoclave, the textile material is dry and can be dyed direct.

The dyeing process is typically carried out by placing the cellulosic textile material pretreated with the auxiliary that promotes dye uptake, together with the disperse dye, into a pressure-resistant dyeing machine and heating to dyeing temperature under $CO_2$ pressure, or by heating and then applying the desired $CO_2$ pressure.

The dyeing temperature used in the novel process will depend substantially on the substrate to be dyed. Normally it will be in the range from c. 90° to 200° C., preferably from c. 100° to 150° C.

The pressure must be at least so high that the $CO_2$ is in the supercritical state. The higher the pressure, as a rule the greater the solubility of the dyes in the $CO_2$, but also the more complicated the apparatus required. Preferably the pressure will be in the range from c. 73 to 400 bar, preferably from c. 150 to 250 bar. At the preferred dyeing temperature of c. 130° C. for cellulosic material the pressure will be c. 200 bar.

The liquor ratio (mass ratio of textile material:$CO_2$) for dyeing by the novel process will depend on the goods to be dyed and on their form of presentation.

Normally the liquor ratio will vary from 1:2 to 1:100, preferably from about 1:5 to 1:75. If it is desired to dye cotton yarns which are wound onto appropriate cheeses by the novel process, then this is preferably done at relatively short liquor ratios, i.e. liquor ratios from 1:2 to 1:5. Such short liquor ratios usually create problems in standard dyeing methods in an aqueous system, as the danger often exists that the high dye concentration will cause the finely disperse systems to agglomerate. This danger does not arise in the inventive process.

After the dyeing temperature has been reached, the desired pressure is applied, if it has not already been reached as a result of the rise in temperature. The temperature and pressure are then kept constant for a time, conveniently from 0.5 to 60 minutes, while ensuring a thorough penetration of the "dye liquor" into the textile material by appropriate measures, typically by stirring or shaking or, preferably, by circulating the dye liquor. The dyeing time is normally not critical; but it has been found that dyeing times of more than 10 minutes usually do not bring about any enhancement of tinctorial yield.

Afterwards the pressure is lowered, most simply by opening a valve and releasing the $CO_2$ overpressure. After opening the valve, the dyed textile material is in the dry state and only needs to be freed from any dye adhering loosely to the fibre, conveniently by washing off with an organic solvent.

A variant of the novel dyeing process comprises lowering the pressure in a plurality of steps, preferably in 2 to 100 steps. The rapid expansion causes a fall in temperature in each step, i.e. the expansion is virtually adiabatic. In addition, the reduction in pressure effects a change in the density of the $CO_2$. After closing the valve, the temperature rises again to ambient temperature, i.e. the renewed rise in pressure is isochoric. After about 30 seconds to a few minutes, when pressure and temperature virtually no longer rise, the pressure is reduced once more and the above procedure is repeated. This procedure is preferably controlled automatically by a pressure and/or density and/or temperature program.

The pressure in each step is preferably reduced by 0.1 to 20 bar, more particularly by 1 to 10 bar and, most preferably, by 2 to 5 bar.

Furthermore, it is preferred to reduce the pressure stepwise from a pressure in the range from 200 to 300 bar to 100 to 130 bar. Afterwards the pressure of 130 bar can be released in one step.

As the density of the supercritical $CO_2$ decreases more rapidly at low temperature when reducing the pressure, it has been found useful to take this circumstance into account by reducing the amount of the reduction in each step.

The textile material is then removed from the dyeing machine and can often be used without further treatment. It must be noted in particular that no drying is necessary.

There are a number of ways in which the supercritical $CO_2$ can be purified after dyeing. Residual dye in the supercritical $CO_2$ can be adsorbed or absorbed on appropriate filters. Particularly suitable for this purpose are the known silica gel, kieselgur, carbon, zeolith and alumina filters.

Another means of removing residual dye from the supercritical $CO_2$ after dyeing consists in raising the temperature and/or lowering the pressure and/or increasing the volume. This procedure effects a reduction in density, such that the reduced density can still be in the supercritical range. This reduction of density can, however, be continued until the supercritical $CO_2$ is converted into the appropriate gas, which is then collected and, after reconversion into the supercritical state, used again for dyeing further substrates. In this procedure, the dyes precipitate as liquid or solid dyes which are then collected and can be re-used for producing further dyeings.

The novel process is suitable for dyeing textile material of natural and regenerated cellulose, typically hemp, linen, jute, viscose silk, viscose rayon and, in particular, cotton. It is also possible to dye blends of cellulose and synthetic organic material, for example cotton/polyamide or cotton/polyester blends.

The fibre materials can be in any form of presentation, typically filaments, flocks, yarn, woven or knitted fabrics, or made-up goods.

Dyes which may be suitably used in the novel process are preferably disperse dyes, i.e. sparingly water-soluble or substantially water-insoluble dyes. Suitable dyes are also compounds which do not absorb in the visible range, typically fluorescent whitening agents or NIR absorbing compounds.

Suitable dyes are typically those of the following classes: nitro dyes such as nitrodiphenylamine dyes, methine dyes, quinoline dyes, aminonaphthoquinone dyes, coumarin dyes, tricyanovinyl dyes and, preferably, anthraquinone dyes and azo dyes such as monoazo and disazo dyes.

Preferably the dyes used are those which are devoid of sulfo and carboxyl groups and have a molecular weight of less then 600.

The invention is illustrated by the following non-limitative Examples.

EXAMPLE 1

A strip of bleached, mercerised cotton fabric is padded with an aqueous solution containing 200 g/l of polyethylene glycol (PEG 400). The pressure of the nip rollers is adjusted such that the fabric takes up 80% of its dry weight. The fabric is subsequently dried at room temperature.

5 g of the above described cotton fabric and 9.1 mg of the dye of formula

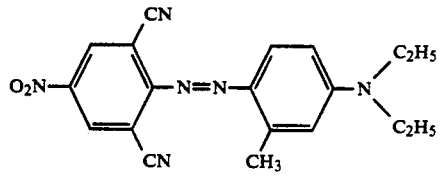

are placed in a 500 ml autoclave equipped with built-in pressure and temperature gauge, stirrer and a stainless steel grille for holding the fabric. The dye is placed on the bottom of the autoclave and then 330 g of $CO_2$ are added in solid form.

After closing the autoclave, the temperature within falls very rapidly to about −10° C. When the temperature has reached 0° C., the contents of the autoclave are heated to 130° C. at a rate of c. 3°/min, the pressure rising at the same time to c. 225 bar. These conditions are kept constant for 30 minutes. The heating is then switched off and the autoclave is cooled with pressurised air, whereupon the pressure and temperature fall exponentially. After 2 hours the pressure is about 70 bar, and this pressure is released by opening a valve.

The cotton fabric is dyed in a deep blue shade.

EXAMPLES 2-5

Following the procedure described in Example 1, dyeings in the indicated shades are obtained on cotton which has been pretreated with polyethylene glycol with the dyes of the following Table in the given amounts.

| Example | Dye | Amount [mg] | Shade |
|---|---|---|---|
| 2 | 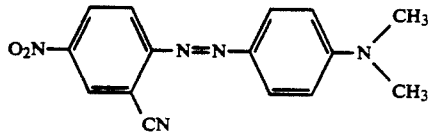 | 7.4 | violet |
| 3 | 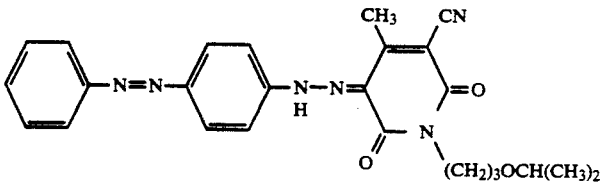 | 11.5 | orange |
| 4 | 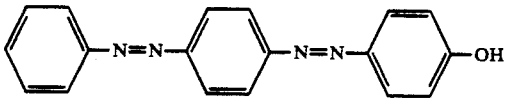 | 7.6 | yellow |
| 5 | 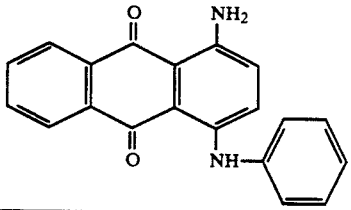 | 7.9 | blue |

EXAMPLE 6

A strip of bleached mercerised cotton fabric (5 g), 5 g of polyethylene glycol (PEG 400) and 330 g of solid $CO_2$ are placed in the autoclave described in Example 1.

After closing the autoclave, the temperature within falls very rapidly to about −10° C. When the temperature has reached 0° C., the contents of the autoclave are heated to 130° C. at a rate of c. 3°/min, the pressure rising at the same time to c. 225 bar. These conditions are kept constant for 30 minutes. The heating is then switched off and the autoclave is cooled with pressurised air, whereupon the pressure and temperature fall exponentially. After 2 hours the pressure is about 70 bar and this pressure is released by opening a valve.

The cotton is dry after this treatment. The autoclave is then additionally charged with 10.2 mg of the dye of formula

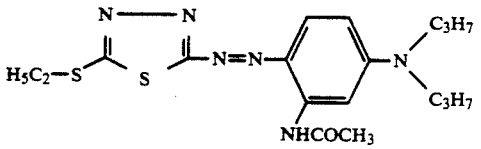

and 330 g of $CO_2$ in solid form and dyeing is then performed as described in Example 1.

The cotton fabric is dyed in a red shade.

EXAMPLE 7

The procedure of Example 6 is repeated, using 9.0 mg of the dye of formula

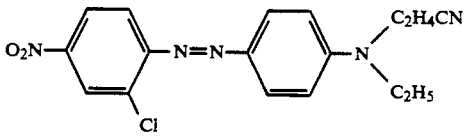

to give also cotton fabric which is dyed in a red shade.

EXAMPLE 8

The procedure described in Example 1 is repeated, but pretreating the cotton with a solution containing 300 g/l of triethanolamine and dyeing with 9 mg of the dye described in Example 7, to give also a cotton fabric which is dyed in a red shade.

EXAMPLE 9–32

The procedure of Example 8 is repeated, using equivalent amounts of the following dyes, to give also dyed cotton fabric.

| Example | Dye |
|---|---|
| 9 | 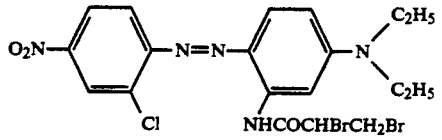 |
| 10 | 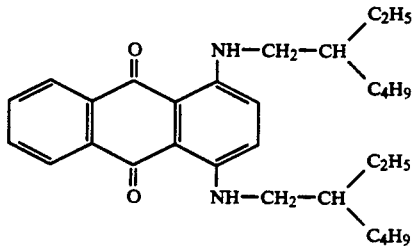 |
| 11 | 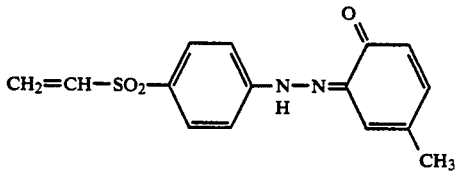 |
| 12 | 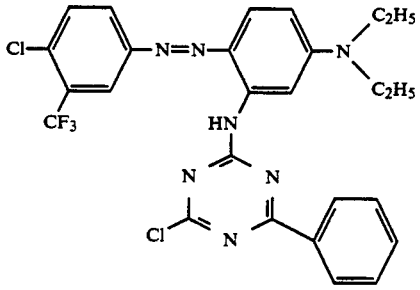 |
| 13 | 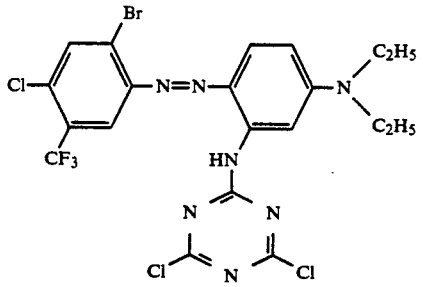 |
| 14 | 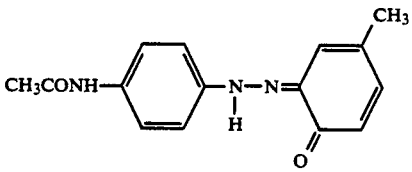 |
| 15 | 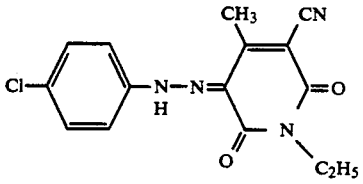 |

-continued
| Example | Dye |
|---|---|
| 16 | 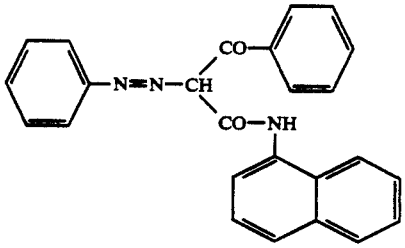 |
| 17 | 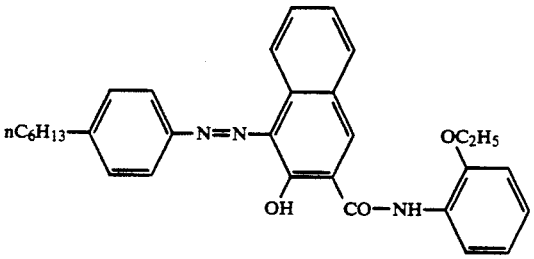 |
| 18 | 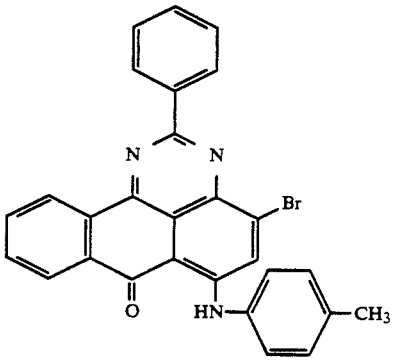 |
| 19 | 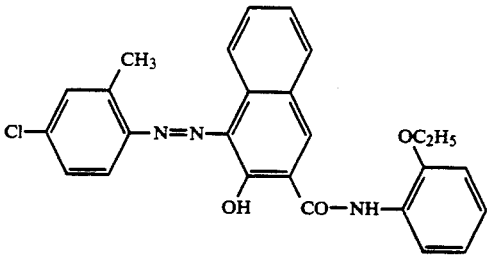 |
| 20 | 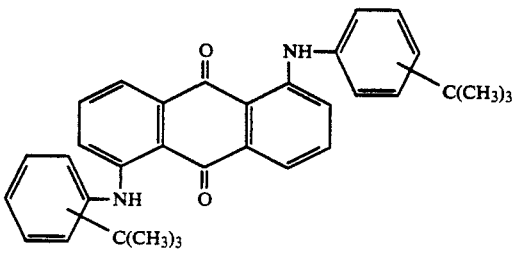 |

-continued
| Example | Dye |
|---|---|
| 21 | 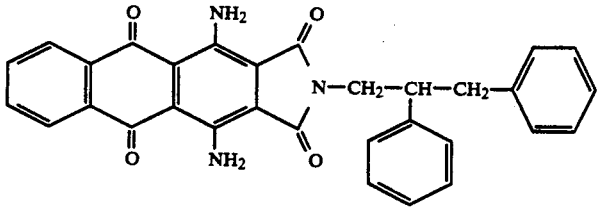 |
| 22 | 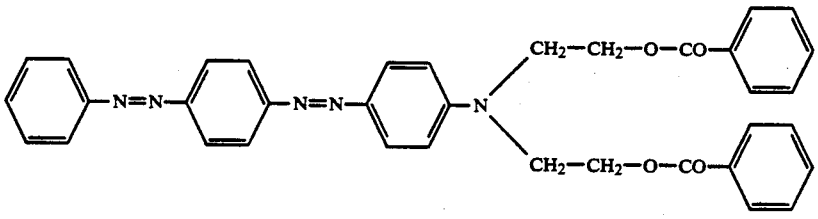 |
| 23 | 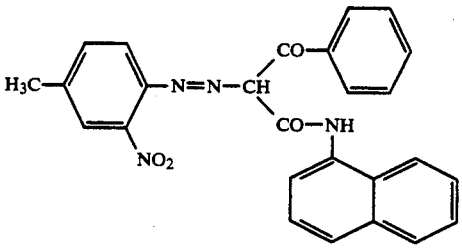 |
| 24 | 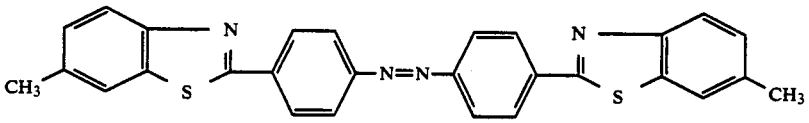 |
| 25 | 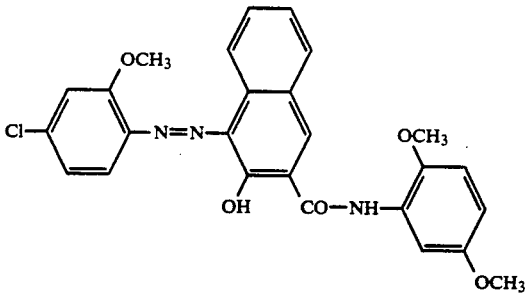 |
| 26 | 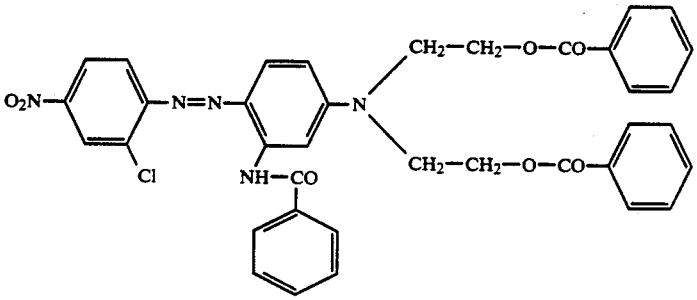 |

-continued
| Example | Dye |
|---|---|
| 27 | 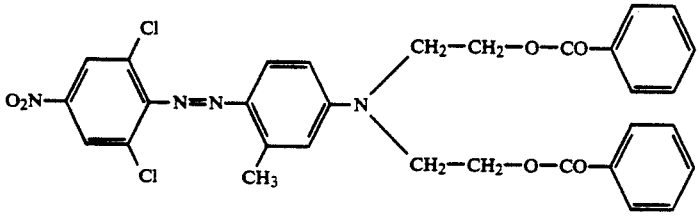 |
| 28 | 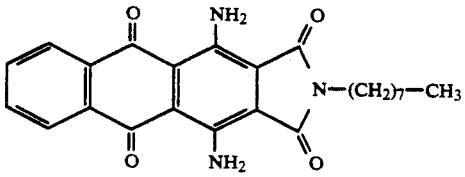 |
| 29 | 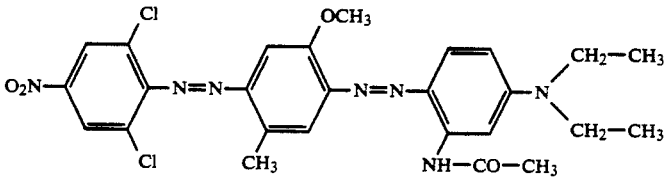 |
| 30 | 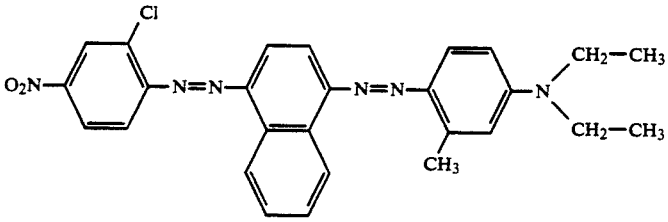 |
| 31 | 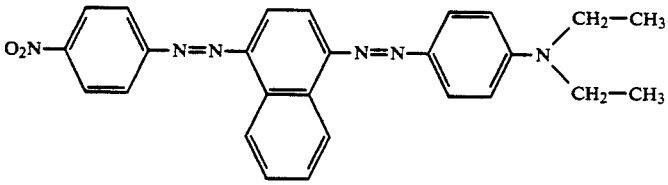 |
| 32 | 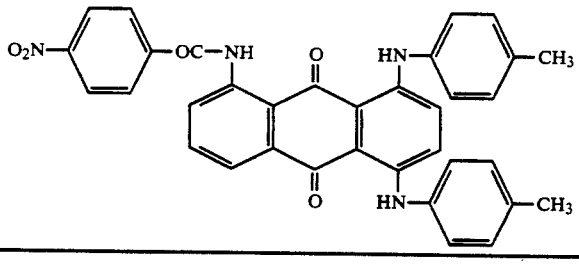 |
EXAMPLES 33-38
In accordance with the procedures described in Examples 1 and 6 it is also possible to dye suitably treated cotton fabric with the following dyes:

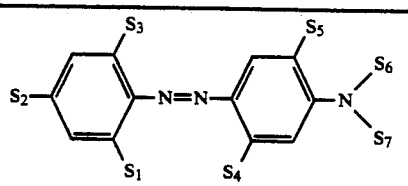

| Ex. | $S_1$ | $S_2$ | $S_3$ | $S_4$ | $S_5$ | $S_6$ | $S_7$ |
|---|---|---|---|---|---|---|---|
| 33 | CN | $NO_2$ | CN | H | H | $C_2H_5$ | $C_2H_5$ |
| 34 | CN | $NO_2$ | H | H | H | $CH_2CN$ | $CH_3$ |
| 35 | CN | $NO_2$ | H | H | H | $C_2H_4OCOCH_3$ | $C_2H_4OCOCH_3$ |
| 36 | Br | $NO_2$ | $NO_2$ | $NHCOCH_3$ | $OCH_3$ | $C_2H_5$ | $C_2H_5$ |
| 37 | Br | $NO_2$ | $NO_2$ | $NHCOCH_3$ | H | $C_2H_5$ | $CH_2C_6H_5$ |
| 38 | Cl | $NO_2$ | $NO_2$ | $NHCOCH_3$ | $OCH_3$ | $C_2H_4OCOCH_3$ | $CH_2C_6H_5$ |

EXAMPLES 39–41

In accordance with the procedures described in Examples 1 and 6 it is also possible to dye suitably treated cotton fabric with the following dyes:

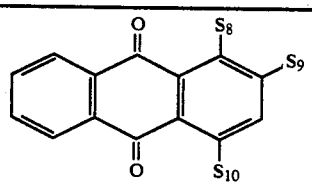

| Ex. | $S_8$ | $S_9$ | $S_{10}$ |
|---|---|---|---|
| 22 | OH | H | 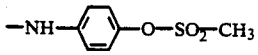 |
| 23 | $NH_2$ | $OCH_3$ | 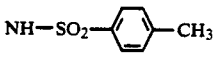 |
| 24 | 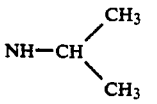 | H | 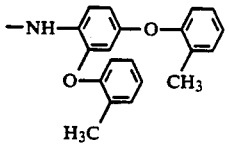 |

What is claimed is:

1. A process for dyeing cellulose textile material with disperse dyes, which comprises pretreating the textile material at least 5% by weight, based on the weight of the textile material of an auxiliary that promotes dye uptake and subsequently dyeing the pretreated material with a disperse dye under pressure and at a temperature of at least 90 degrees celsius from supercritical $CO_2$, said auxiliary being selected from the group consisting of a polyalkylene glycol, an alkanolamine and an aromatic compound with several hydroxyl groups.

2. A process according to claim 1, wherein the auxiliary that promotes dye uptake is a polyethylene glycol, a polypropylene glycol, a di- or trialkanolamine containing 2 to 5 carbon atoms in the alkyl moieties, or a phenol derivative which carries 1 to 3 OH groups.

3. A process according to claim 2, wherein the auxiliary that promotes dye uptake is selected from the group consisting of resorcinol, triethanolamine and polyethylene glycol.

4. A process according to claim 1, wherein the auxiliary that promotes dye uptake is used in an amount of 5 to 60% by weight, based on the cellulosic material.

5. A process according to claim 1, wherein the cellulosic material is pretreated with an aqueous solution containing the auxiliary that promotes dye uptake.

6. A process according to claim 1, wherein the cellulosic material is pretreated in supercritical $CO_2$ with the auxiliary that promotes dye uptake.

7. A process according to claim 1, wherein the disperse dye is a dye which is devoid of sulfo and carboxyl groups and has a molecular weight of less than 600.

8. A process according to claim 7, wherein the dye is an azo or anthraquinone dye.

9. A process according to claim 8, which comprises the use of a disperse dye which contains no diluents and dispersants.

10. A process according to claim 1, wherein dyeing is carried out by heating the pretreated textile material to temperatures in the range from about 90° C, to about 200° C.

11. A process according to claim 10, which is carried out under a pressure from about 73 to about 400 bar, preferably.

12. A process according to claim 1, wherein the substrate is initially dyed in a liquor to goods ratio of about 1:2 to about 1:100.

13. A process according to claim 1, wherein the supercritical $CO_2$ is purified after the dyeing procedure and re-used for dyeing.

14. A process according to claim 13, wherein the supercritical $CO_2$ is purified on a filter.

15. A process according to claim 13, wherein the supercritical $CO_2$ is purified by a temperature increase and/or pressure reduction and/or volume expansion.

16. Cellulosic textile material dyed by a process as claimed in claim 1.

17. A process of claim 4 wherein the amount is of the auxiliary is 10 to 30% by weight, based on the cellulosic material.

18. A process of claim 10 wherein the temperature range is from about 100° C. to about 150° C.

19. A process of claim 11 wherein the pressure is from about 150 to about 250 bar.

20. A process of claim 12 wherein the ratio is about 1:5 to about 1:75.

* * * * *